United States Patent [19]

Lipscher et al.

[11] Patent Number: 4,577,181

[45] Date of Patent: Mar. 18, 1986

[54] ALARM SYSTEM FOR ELECTRIC RANGE

[76] Inventors: Bernard Lipscher, 8 Hamilton Ave.; Kevin G. Coleman, 3 Franklin Ave., both of Wheeling, W. Va. 26003

[21] Appl. No.: 707,950

[22] Filed: Mar. 4, 1985

[51] Int. Cl.[4] ..... G08B 19/00; H05B 1/02

[52] U.S. Cl. ..... 340/522; 340/568; 340/613; 340/624; 340/640; 340/666; 219/518; 219/452; 219/453; 200/85 R; 126/42

[58] Field of Search ..... 340/522, 568, 584, 586, 340/613, 623, 624, 640, 666, 667, 635; 219/518, 450, 451, 452, 453; 200/85 R, 85 A, 61, 76, 61.74; 126/39 M, 40, 42, 51

[56] References Cited

U.S. PATENT DOCUMENTS

| | | | |
|---|---|---|---|
| 4,334,145 | 6/1982 | Norris, Sr. | 219/518 |
| 4,394,565 | 7/1983 | Dills | 219/453 |
| 4,446,455 | 5/1984 | Nashawaty | 219/518 |

*Primary Examiner*—Donnie L. Crosland

*Attorney, Agent, or Firm*—Bernard, Rothwell & Brown

[57] ABSTRACT

An alarm system for an electric range which detects when a burner is energized without a utensil in place on the burner wherein the sensing means comprises an electrical switch mounted below the stovetop having a first switch position and a second switch position, a pin slidably passing through an opening in the stovetop beneath the rim of the dish under the heating element in contact with the underside of the rim and biased against the rim with a pressure sufficient to lift the rim from the stovetop when no utensil is present on the heating element, but insufficient to lift the rim when a utensil is in place on the heating element; and means connecting said pin with the switch to operate the switch between first and second positions corresponding to the position of the pin when a utensil is present or absent from the heating element.

3 Claims, 4 Drawing Figures

ALARM SYSTEM FOR ELECTRIC RANGE

FIELD OF THE INVENTION

This invention relates to an alarm system for an electric range for actuating an alarm when a burner is energized without having a cooking utensil placed on the burner.

BACKGROUND OF THE INVENTION

In 1980, the National Fire Prevention Association determined that 77% of residential fires originated in the kitchen and the leading cause was traced to the range or cooking unit. An alarm device that would warn the stove operator when a burner on an electric range has been energized but is not in use could help prevent such fires. The alarm system would also serve to save energy, lengthen the time of service of the burner and aid the blind and visually impaired.

Norris, in U.S. Pat. No. 4,334,145, issued June 8, 1982, discloses an alarm system for an electric range with a mechanically operated switch under each burner which deactivates the alarm when a cooking utensil is on the burner and the burner is energized. Because of the proximity of the alarm switching means to the burner, this arrangement can cause heat to be conducted down into the range damaging the wiring and the sensing switch. Also, the lever and fulcrum system used to operate the switch is susceptible to damage due to food or grease which may be spilled on the burner.

Nashawaty in U.S. Pat. No. 4,446,455, issued May 1, 1984, describes an alarm system useful in both electric or gas ranges and which is actuated when a burner is energized when there is no cooking utensil on the heating element. However, the alarm system disclosed is activated by a power source which is separate from the burner, such that the alarm system could fail and not emit a signal even when a burner is energized without a utensil placed on it. As in the Norris patent, there are also the problems of heat conduction into the range and damage to the switch if food is spilled into the burner.

SUMMARY OF THE INVENTION

In accordance with the present invention an alarm system for an electric range is disclosed which detects when a burner is energized without a utensil in place on the burner. The invention may be used in an electric range having a generally planer stovetop with openings for burners and having dishes situated in the openings, supported by rims which rest on the stovetop. A heating element rests in each dish and is energized by electric current controlled by a burner control switch.

In order to solve the problems of previous alarm systems, the invention has a sensing means which is an electrical switch having a first switch position and a second switch position mounted below the stovetop and connected to a pin slidably passing through an opening in the stovetop beneath the rim of the dish in contact with the underside of the rim of the dish and biased against the rim with a pressure sufficient to lift the rim from the stovetop when no utensil is present on the heating element, but insufficient to lift the rim when a utensil is in place on the heating element. Means connecting the pin to the switch operates the switch between the first and second positions according to the position of the pin when a utensil is present or absent from the heating element.

DETAILED DESCRIPTION OF THE INVENTION

Figure 1:
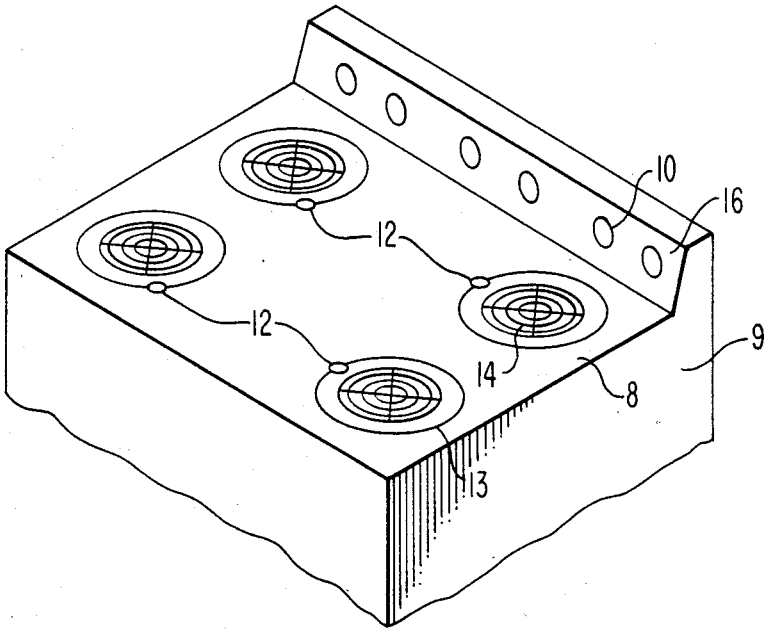
FIG. 1 is a perspective view of a stovetop showing the placement of the switches employed in the alarm system of this invention.

As illustrated in FIG. 1, the alarm system is used in connection with an electric range 9, having a generally planar stovetop surface 8 in which there are openings for heating elements 14. The sensing means for each element in the alarm system is a switch 12 mounted beneath the stovetop adjacent to each burner.

Figure 2:
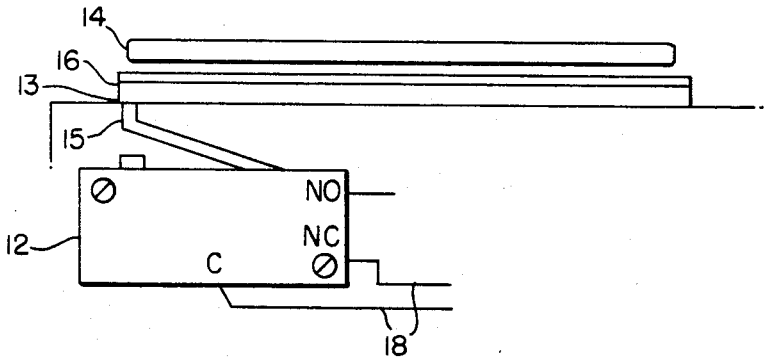
FIG. 2 is a side sectional view showing the placement of the switch under the heating element.

FIG. 2 shows an individual unit with a switch 12 connected to a pin 15 lifting the rim 13 of the burner dish 16 which supports heating element 14. The pin slidably passes through an opening in the stovetop beneath the rim of the dish and contacts the underside of the rim. The pin is biased against this rim and exerts pressure on it sufficient to lift the rim, preferably about 1/16 inch off the surface of the stovetop, when no utensil is present on the heating element. This pressure is insufficient to lift the rim when a utensil is placed on the heating element. Rim 15 can be biased against the underside of the rim 13 by any suitable means, such as a spring (not shown) inside the casing of switch 12.

Figure 3:
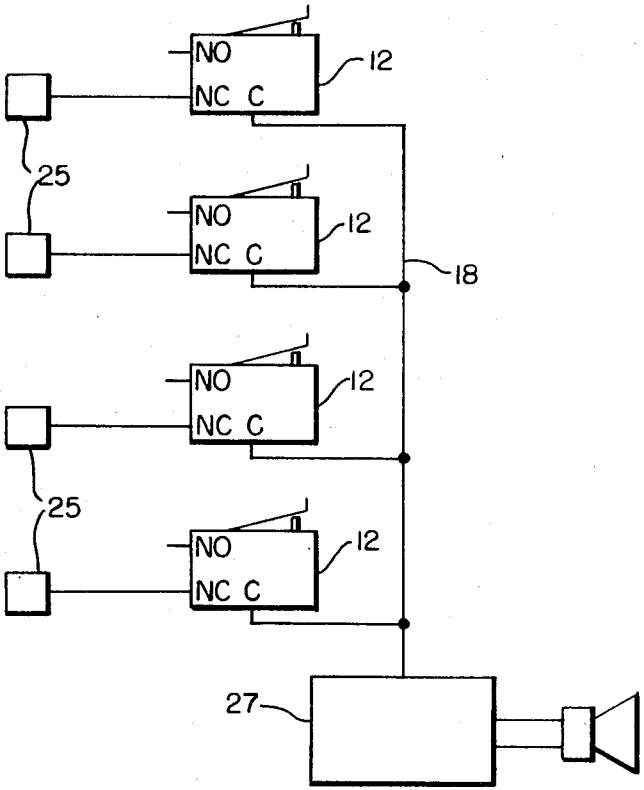
FIG. 3 is a schematic block diagram of the alarm system.

The switch 12, which has two positions, is connected to an alarm circuit 27 through wires 19 as shown in FIG. 3. The alarm circuit is controlled by both a burner control switch 25 and switch 12. The burner control switch is preferably the existing control switch used for each burner on the range. When the burner control switch is turned on, current flows on the heating element and to switch 12. If no utensil is on heating element 14, switch 12 is in a position to activate the alarm. If a utensil is on heating element 14, the weight of the utensil forces rim 13 onto the stovetop 8 and, through pin 15, activates switch 12 to a second position. The power to the alarm circuit 27 is thus interrupted. As indicated in FIG. 3, when several heating elements are in the stovetop, each may be wired, in parallel, into the alarm circuit.

In a preferred embodiment, the two positions of the switch are open and closed. If the circuit is designed such that the switch is normally closed, then the pin will open the switch when a utensil is placed on the heating element. However, when no utensil is on the element, the pin will raise the rim and leave the switch in the closed position so that the current will flow from the power source activated by the burner control to the alarm circuitry. The alarm circuitry could also be designed to accommodate a normally open switch.

Figure 4:
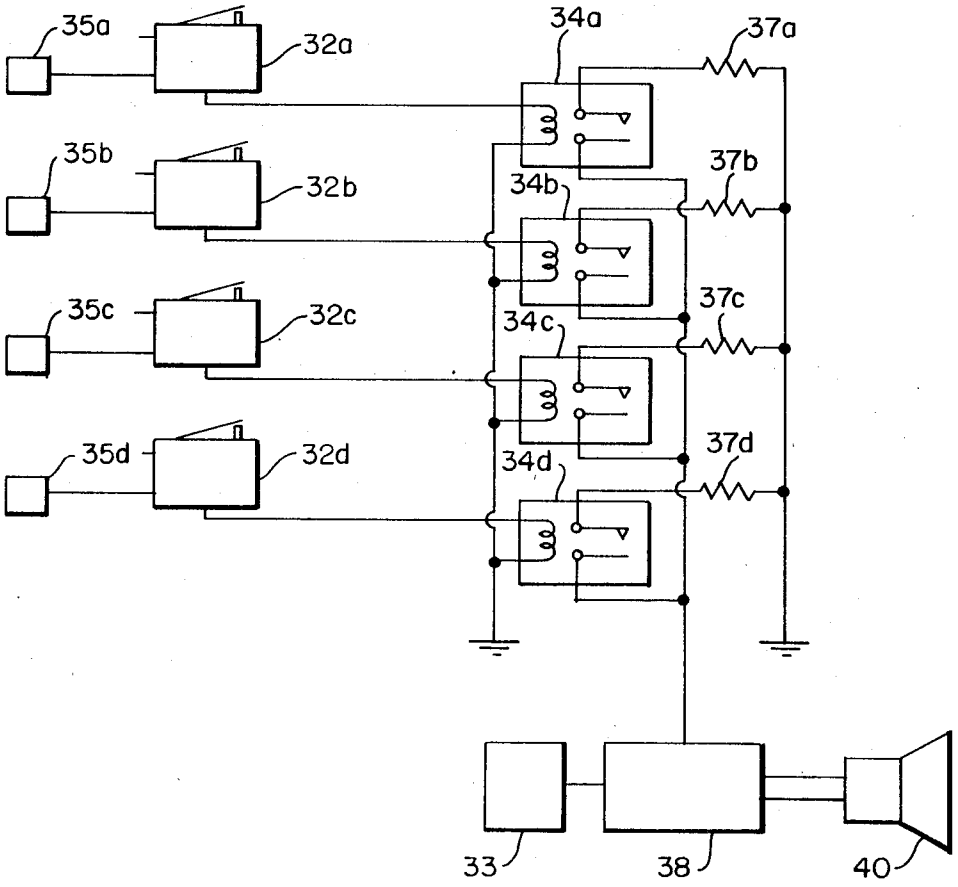
FIG. 4 is a schematic block diagram of an alternative embodiment of the alarm system.

The alarm device may be audible or visible or both. Examples are buzzers, bells, and flashing lights. For the visually impaired, different tones may be used for each heating element on the stovetop to signal which element has been energized without a utensil placed on it. Such a system is illustrated in FIG. 4 of the drawings in which power from each burner control switch 35 is carried to each switch 32 which is positioned beneath the stovetop as described above. When any one of switches 32 are closed, power from the corresponding burner control switch is carried to relay 34, causing the contacts of the relay 34 to close. The closing of the relay contacts places corresponding resistor 37 in the resonance circuitry of oscillator 38 which is powered by power supply 33. The output of oscillator 38 is connected to speaker 40. The resistances of each of resistors 37*a*–37*d* can be selected such that the output frequency of oscillator 38, and thus the audible tone of speaker 40, is different for each burner. The circuitries of oscillator 38 and power supply 33 are conventional and well known. Suitable oscillators are commercially available as integrated circuits, which are preferred for use in the present invention.

For convenience, the alarm device may be integrated into the control panel 11 of a stove as shown in FIG. 1, the alarm device may have an operating voltage range of 3 to 28 volts, d.c., which is easily integrated into the digital controls of modern electric ranges. The voltage applied to the heating elements can be stepped down and rectified using conventional circuitry such that it is compatible with the alarm circuitry. The output of an audible signal should be about two watts, or enough to be heard in the next room.

Other embodiments of the invention will occur to those skilled in the art which are within the scope of the following claims.

We claim:

1. In an alarm system for an electric range for detecting when a burner is energized without a utensil in place on said burner, said electric range having:

a generally planar stovetop with an opening for a burner, a dish which rests in said opening, said dish having a rim that rests on the stovetop and supports the dish, and a heating element which rests in said dish and which is energized by electric current controlled by a burner control switch; and said alarm system having a sensing means for detecting the presence or absence of a utensil on the heating element and an alarm means responsive to said sensing means and said burner control switch; the improvement, wherein said sensing means comprises:

an electrical switch mounted below the stovetop having a first switch position and a second switch position;

a pin slidably passing through an opening in said stovetop beneath the rim of said dish in contact with the underside of said rim and biased against said rim with a pressure sufficient to lift the rim from the stovetop when no utensil is present on the heating element, but insufficient to lift the rim when a utensil is in place on the heating element, means connecting said pin with said switch to operate the switch between the first and second positions corresponding to the position of the pin when a utensil is present or absent from the heating element.

2. The improvement of claim 1 wherein the positions of the electrical switch are open and closed.

3. In an electric range with more than one heating element and one electric switch under each element, the improvement of claim 1 wherein the frequency output of the alarm system varies depending upon which switch is activated.

* * * * *